US005802726A

United States Patent [19]

Trosper, Jr. et al.

[11] Patent Number: 5,802,726

[45] Date of Patent: Sep. 8, 1998

[54] ARCHERY BOW SIGHT

[76] Inventors: Don L. Trosper, Jr., 606 S. Seminary St., Georgetown, Ill. 61846; David L. Rehder, 22472 Queen St., Castro Valley, Calif. 94546

[21] Appl. No.: 827,602

[22] Filed: Mar. 28, 1997

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,289,300 | 12/1966 | Jordan | 33/265 |
| 4,620,372 | 11/1986 | Goodrich | 33/265 |
| 4,625,420 | 12/1986 | Figured | 33/265 |
| 4,669,194 | 6/1987 | Amacker | 33/265 |
| 4,915,088 | 4/1990 | Powers | 33/265 |
| 4,967,478 | 11/1990 | Sherman | 33/265 |
| 5,025,565 | 6/1991 | Stenerson et al. | 33/265 |
| 5,050,576 | 9/1991 | Larson | 33/265 |
| 5,220,907 | 6/1993 | Lonsdale | 33/265 |
| 5,464,003 | 11/1995 | Sherman | 33/265 |
| 5,632,091 | 5/1997 | Brion et al. | 33/265 |

*Primary Examiner*—Thomas B. Will
*Attorney, Agent, or Firm*—Philip L. Bateman

[57] ABSTRACT

An archery bow sight mounts to a bow at a point above the handle and arrow rest. The archery bow sight contains two frames located a short distance apart, a near frame and a far frame. Each frame contains a filament that is vertical when the bow is in the shooting position and a plurality of filaments that are horizontal when the bow is in the shooting position. Each filament is located in a plane perpendicular to the plane formed by the bow and bowstring. When the bow is in the shooting position, each filament in the far frame is located in a plane passing through the corresponding filament in the near frame and the eye of the archer. The intersection of the superimposed vertical filaments with each pair of corresponding superimposed horizontal filaments defines a sight for a target of a particular distance.

14 Claims, 3 Drawing Sheets

ARCHERY BOW SIGHT

FIELD OF THE INVENTION

This invention relates to the sport of archery. More particularly, this invention relates to an archery bow sight and a method of using an archery bow sight.

BACKGROUND OF THE INVENTION

The bow and arrow were first used in prehistoric times for hunting and warfare. Firearms have long since replaced the bow and arrow for warfare and for most types of hunting. However, the bow and arrow continue to be used for sport, including some types of hunting and target shooting. The sport of shooting with a bow and arrow is known as archery.

Most modern bows include a sight to help the archer aim the bow. The sight is mounted on the bow just above the handle and arrow rest as shown in FIG. 1. A right-handed archer holds the bow in a vertical position with his left hand, pulls the bowstring back to a point near his right cheek, known as the anchor point, with his right hand, and then positions the bow so that the target is viewed through the sight with his right eye. An arrow shot at a target travels in a downward trajectory due to the force of gravity. The amount of the trajectory depends on the time of flight which is, in turn, determined by the distance to the target and the speed at which the arrow travels. The arrow speed is a function of the draw weight of the bow and the distance which the bowstring is pulled. The trajectory must be accounted for when aiming the bow. As the target distance increases, the angle above the horizontal at which the arrow is aimed increases.

Many types of archery bow sights are used. Some sights contain a single sighting point or multiple sighting points in a vertical array at a single distance from the archer. However, greater accuracy is achieved with archery bow sights having at least two sighting points located a short distance apart. The archer aligns two sighting points with the target to aim the bow. The sighting point nearest the archer is referred to as the near or back point and the sighting point farther away is referred to as the far or front point. Archery bow sights with both near and far sighting points typically provide several sighting points at the near and/or far position for aiming at targets of different distances. Archery bow sights with multiple sighting points at the near and/or far position are of one of three basic types.

The first type of archery bow sight contains a single near sighting point and a set of vertical far sighting points a short distance farther away from the archer. This type of sight is represented in FIG. 2 with the archer's eye shown aiming at a round target using the single near sighting point and the middle of three vertically-arrayed far sighting points. An archery bow sights of this type is disclosed in Powers, U.S. Pat. No. 4,915,088, issued Apr. 10, 1990. This type of archery bow sight enables an archer to choose a particular sighting point best corresponding to the distance of the target. However, the use of this type of sight requires the archer to make slight changes in the anchor point. For maximum accuracy, an archer would prefer keep the anchor point at exactly the same location every time. This bow sight is also difficult to calibrate because the anchor point must be moved for each target distance. Finally, this type of bow sight is difficult to use in situations where the bow must be aimed quickly at targets of varying distances, as frequently occurs when hunting. In these situations, the archer can easily align the wrong sighting point because the points are not easily distinguished.

The second type of archery bow sight contains a set of near vertical sighting points at the bow and a single far sighting point a short distance farther away from the archer. This type of sight is represented in FIG. 3. Archery bow sights of this type are disclosed in Figured, U.S. Pat. No. 4,625,420, issued Dec. 2, 1986, and Sherman, U.S. Pat. No. 4,967,478, issued Nov. 6, 1990. This type of archery bow sight suffers from the same disadvantages as the first type of archery bow sight, namely, the anchor point must be changed and it is difficult to distinguish the multiple sighting points.

The third type of archery bow sight contains multiple vertical sighting points at both the near and far positions. This type of sight is represented in FIG. 4. The sighting points in each set are the same distance apart and the lines of sight through each pair of sighting points are parallel. Archery bow sights of this type are disclosed in Jordan, U.S. Pat. No. 3,289,300, issued Dec. 6, 1966; Goodrich, U.S. Pat. No. 4,620,372, issued Nov. 4, 1986; and Amacker, U.S. Pat. No. 4,669,194, issued Jun. 2, 1987. To shoot with a sight of this type, the anchor point must be altered depending on the distance of the target and which pair of sighting points are used.

It can be seen that a demand exists for an archery bow sight that does not require the anchor point to be altered, that enables and requires the archer to precisely reach the anchor point every time, that enables the archer to instantly choose and easily distinguish the appropriate sighting points for a target of a given distance, that is easily used in low light situations, and that is easily calibrated for a given bow.

SUMMARY OF THE INVENTION

The general objects of this invention is to provide an improved archery bow sight and a method of using it. More particular objects are to provide an archery bow sight that does not require the anchor point to be altered, that enables and requires the archer to precisely reach the anchor point every time, that enables an archer to instantly choose the appropriate sighting points for a target of a given distance, that is easily used in low light situations, and that can be easily calibrated for a given bow.

We have invented an improved archery bow sight of the type that mounts on a bow above the handle and through which the archer views when holding the bow in a vertical shooting position and aiming at a target. The archery bow sight comprises: (a) a near frame in a plane perpendicular to the plane formed by the bow and the bowstring, the near frame containing a filament that is vertical when the bow is in the shooting position and a plurality of filaments that are horizontal when the bow is in the shooting position, the filaments being in the same plane as the near frame; and (b) a far frame located farther away from the archer than the near frame when the bow is in the shooting position, the far frame being in a plane perpendicular to the plane formed by the bow and the bowstring, the far frame containing a filament that is vertical when the bow is in the shooting position and a plurality of filaments that are horizontal when the bow is in the shooting position, the filaments being in the same plane as the far frame, each filament in the far frame corresponding to a filament in the near frame to form a corresponding pair, the spaces between the horizontal filaments in the far frame being greater than the spaces between the horizontal filaments in the near frame, the filaments in the far frame located in a plane passing through the corresponding filament in the near frame and the eye of the archer so that each pair of corresponding filaments appear superimposed when the bow is in the proper shooting position, the intersection of the corresponding vertical filaments and each pair of corresponding horizontal filaments defining a specific sighting point for a target of a particular distance.

The archery bow sight of this invention does not require the anchor point to be altered. Instead, it enables and requires the archer to precisely reach the same anchor point prior to each shot because only when the precise anchor point is reached does the sight come into alignment. Because the sighting points are easily distinguished, an archer can instantly choose the appropriate sighting points for a target of a given distance. The archer views the target through a relatively large field of vision with only a plurality of filaments in his line of sight, thus enabling the archery bow sight to be effectively used even in low light situations. The frames and the filaments are easily adjusted to calibrate the archery bow sight for a given bow.

DETAILED DESCRIPTION OF THE INVENTION

Figure 5:
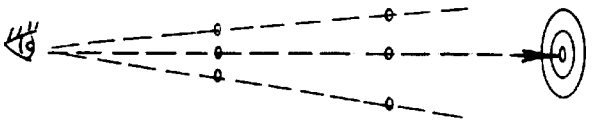
FIG. 5 is a representation of the archery bow sight of this invention.

The archery bow sight of this invention uses the intersection of vertical and horizontal filaments in two frames as its sighting points. The vertical filaments are used for left-right arrow placement and the horizontal filaments are used for different distances to the target. One vertical filament and a set of vertically-arrayed horizontal filaments in a near frame correspond, respectively, with a vertical filament and a set of vertically-arrayed horizontal filaments in a far frame. All corresponding pairs of filaments are simultaneously aligned and the plane of each respective pair converges at the archer's eye when, and only when, the bow is in the proper shooting position, i.e., the bow is drawn to the proper anchor point. In other words, lines of sight passing through the corresponding pairs of filaments converge at the archer's eye. Stated still differently, each corresponding pair of filaments are in a superimposed alignment when, and only when, the bow is precisely drawn to the anchor point. This relationship between three corresponding pairs of horizontal filaments is represented in FIG. 5. The intersection of the vertical filaments with each corresponding pair of horizontal filaments forms the sighting point for a target of a given distance. In FIG. 5, the middle pair of horizontal filaments are part of the sighting point for the target shown. To aim the bow, the archer draws the bow to the anchor point, chooses the appropriate pair of horizontal filaments based on the distance of the target, and aligns the intersection of that pair of horizontal filaments and the pair of vertical filaments on the target.

Figure 2:
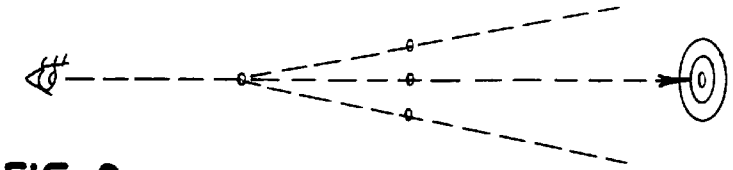
FIG. 2 PRIOR ART
FIG. 2 is a representation of a first type of archery bow sight disclosed in the prior art.
Figure 3:
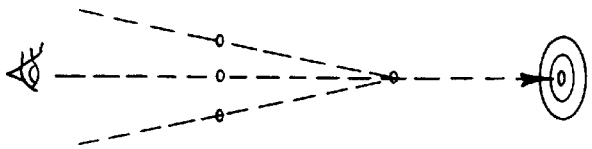
FIG. 3 PRIOR ART
FIG. 3 is a representation of a second type of archery bow sight disclosed in the prior art.
Figure 4:
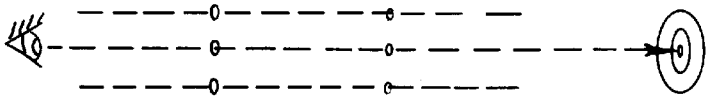
FIG. 4 PRIOR ART
FIG. 4 is a representation of a third type of archery bow sight disclosed in the prior art.
Figure 1:
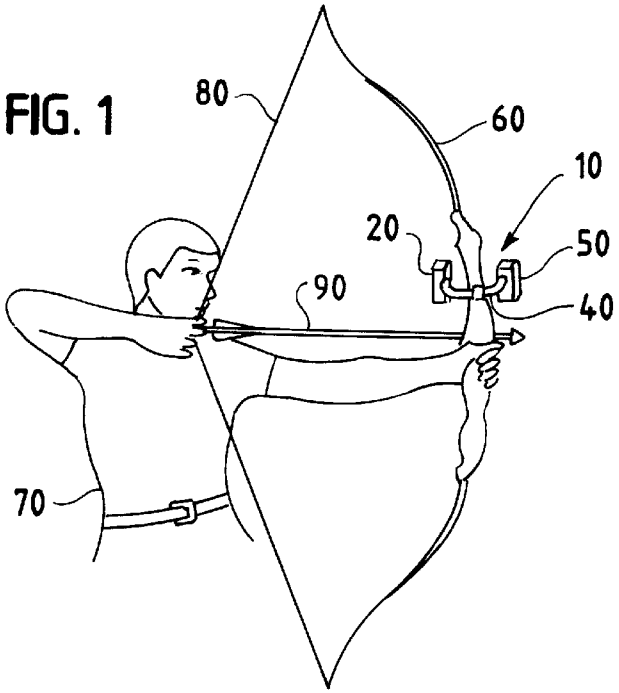
FIG. 1 is a perspective view of an archer aiming a bow with the archery bow sight of this invention.

In FIG. 1, a preferred embodiment of the archery bow sight of this invention 10 is shown mounted on a bow 60 being held in the shooting position by an archer 70. The archery bow sight mounted on the bow is shown in greater detail in FIG. 6. The bow shown is of the recurve type having tips that curve away from the archer. Recurve bows are the most common type of bow used for target shooting. The archery bow sight is also suitable for use with other types of bows, including compound bows, straight bows, and cross-bows. The bow sight contains a near frame 20, a mount 40, and a far frame 50, each of which is discussed in detail below. The bowstring 80 is pulled back to a point near the archer's right cheek known as the anchor point. The arrow 90 contains a notch at one end that engages the bowstring. The pointed end of the arrow rests on the arrow rest 61 of the bow.

Figure 6:
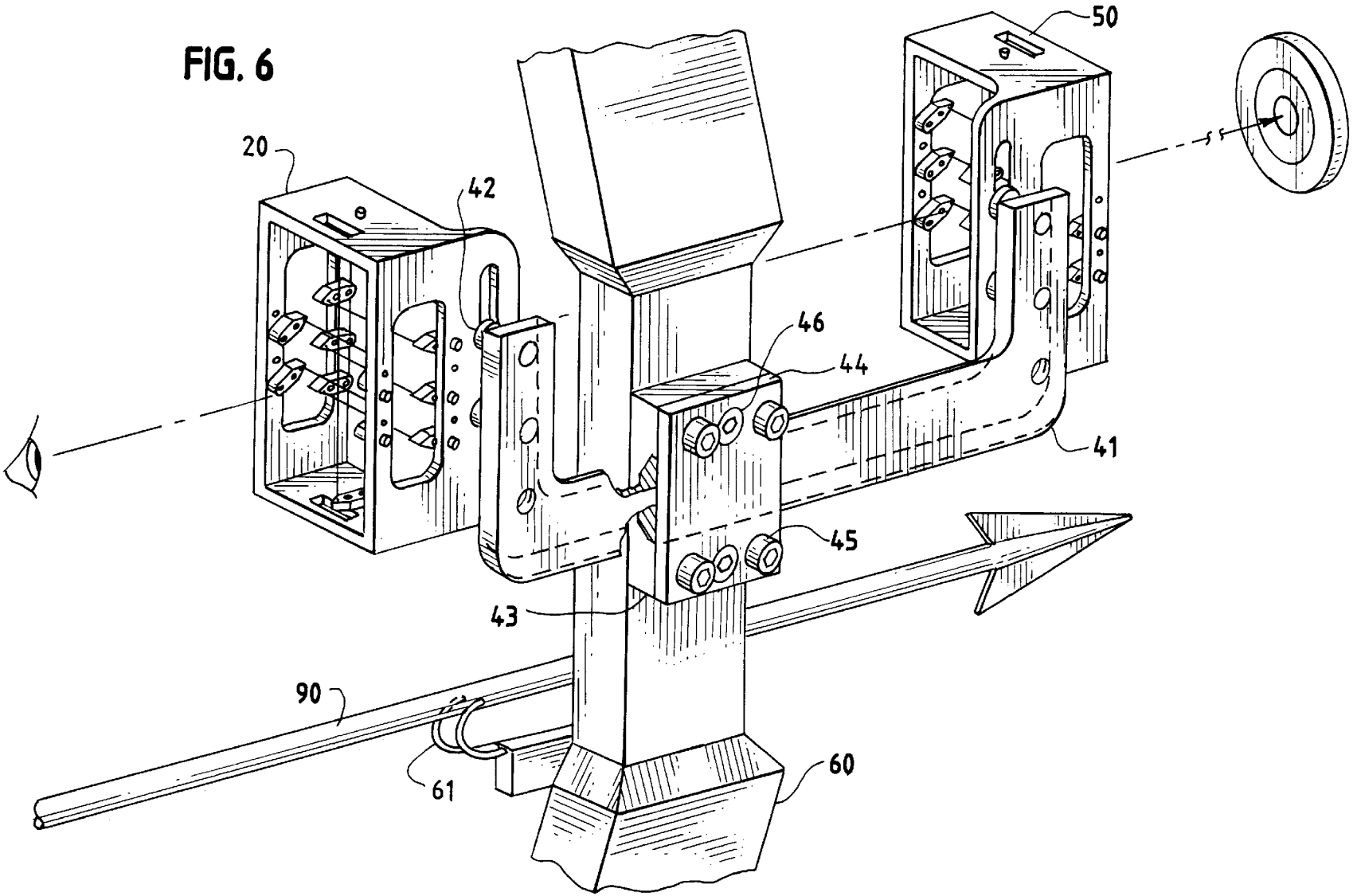
FIG. 6 is a perspective view, partially in section, of the preferred embodiment of the archery bow sight of this invention mounted on a bow.

The near frame and far frame are similar or identical in construction. In the preferred embodiment, the two frames are identical. As can be seen in FIGS. 1 and 6, both frames are perpendicular to the plane formed by the bow and bowstring. In other words, the frames are oriented so the archer looks through them when aiming at the target. For clarity, the near frame is shown isolated in FIGS. 7 through 10. The description of the near frame also applies to the far frame, unless noted. The frame is formed of metal, plastic, or other strong and lightweight material. The preferred material is black anodized aluminum because of its strength, light weight, low cost, ease of machining, non-glare finish, and freedom from rust. One side of the frame includes a rear extension 21 containing a slot 22. As explained below, the slot is used to attach the frame to the mount. The frame is rectangular in shape and has a height of about 3 in (7.5 cm), a width of about 2 in (5 cm), and a depth of about 1 in (2.5 cm), not including the rear extension. The size and shape of the frame is a matter of choice in that the function of the frame is simply to hold the filaments. As the frame size increases, the target area that can be viewed through the frame (the field of vision or view) increases, but the cost, weight, and size of the archery bow sight also increase.

The frame of the preferred embodiment contains six filaments. Filament 23 is vertical and filaments 24, 25, 26, 27, and 28 are horizontal. The intersection of the filaments themselves are the sighting points in the archery bow sight. Each horizontal filament represents a target of a certain distance so the number of horizontal filaments is a matter of choice depending on the target distances to be encountered. For example, filament 24 could be used as the 10 yard (10 m) sight, filament 25 as the 20 yard (20 m) sight, and so on. The number of horizontal filaments is generally about 2 to 10. The filaments are made of a strong material such as metal or plastic. The preferred filament material is polymeric or co-polymeric monofilament of the type commonly used for fishing line. Examples of such monofilament include commercial products sold under the BERKLEY, STREN, MAXIMA, and FENWICK trademarks. The filaments generally have a diameter of about 0.01 to 0.04 in (0.3 to 1 mm). Smaller diameters provide the best resolution while larger diameters are stronger and easier to see in low light situations. The filaments are preferably translucent or opaque so they can be easily seen. While all the filaments can be of the same color, it is preferred that each corresponding pair of filaments be the same color and of a different color than adjacent corresponding pairs of filaments to enable an archer to easily and quickly distinguish and choose the appropriate pair of filaments for aiming. It is most preferred that each corresponding pair of horizontal filaments be of a different color.

Figure 10:
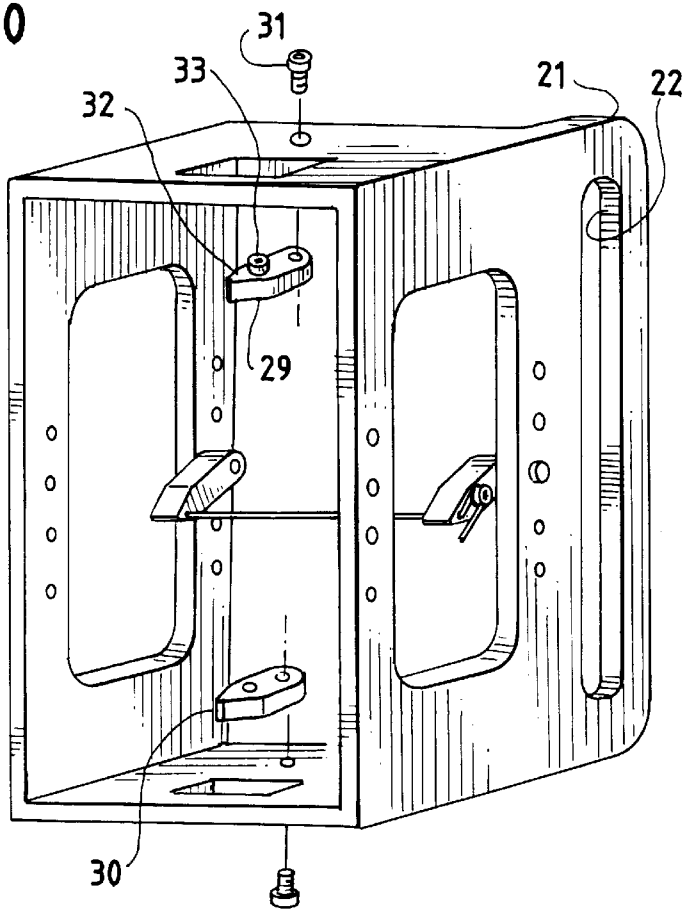
FIG. 10 is a partially exploded oblique view thereof with certain components omitted for clarity.
Figure 9:
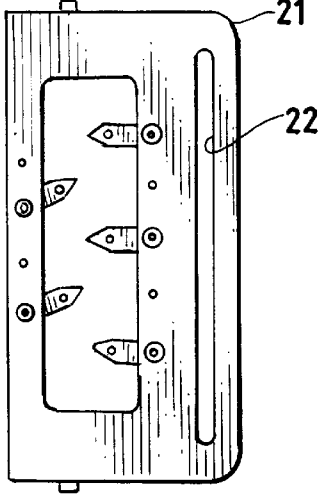
FIG. 9 is a side elevation view thereof.
Figure 7:
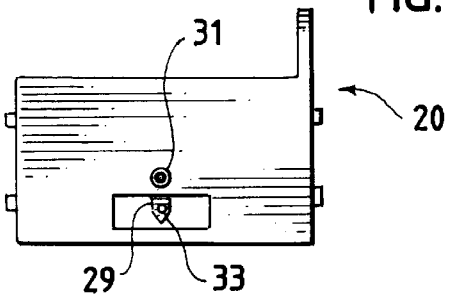
FIG. 7 is a top plan view of the near frame of the archery bow sight shown in FIG. 6.
Figure 8:
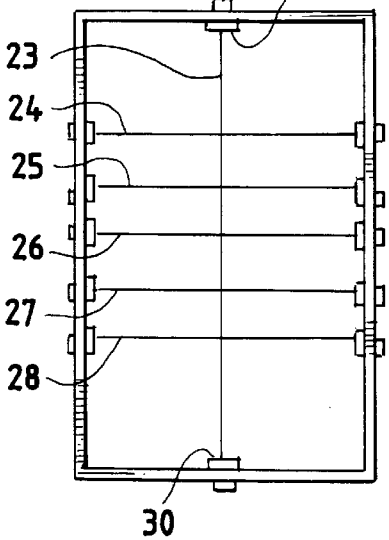
FIG. 8 is a front elevation view thereof

Each filament is suspended between two arms. The structure of the arms is best seen in FIG. 10 where the near frame is shown with only one horizontal filament in place and with the arms for the vertical filament exploded for clarity. Using the vertical filament as an example, a top arm 29 is located on the inside surface of the top of the frame and the other arm 30 is located on the inside surface of the bottom of the frame. The top arm is secured to the frame by hold-down screw 31. The filament is threaded through a hole 32 in the tip of the arm and then secured to the top arm by clamping screw 33. The lower arm and the arms for the horizontal filaments are of similar structure. The position of the vertical filament is moved from side to side, i.e., horizontally, by loosening the hold-down screws, rotating the arms, and then retightening the hold-down screws. The horizontal filaments are moved up and down, i.e., vertically, in the same manner. The filaments are easily replaced without moving the position of the arms, enabling the archer to easily customize the sight with the size and color of filaments desired without having to recalibrate the sight.

The mount secures the archery bow sight to the bow as shown in FIG. 6. The mount also enables the position of the near and far frames to be adjusted. The mount is constructed of the same type of material as the frames. The mount contains a U-shaped bracket 41 that attaches to and supports the near and far frames. The bracket spaces the frames a distance of about 5 in (13 cm) apart. The slot in each of the frames enables them to be moved up and down relative to the bracket. The near frame is generally positioned above the far frame so that the frames reach the same horizontal position when the bow is angled upwardly for shooting at a distant target. Spacers 42 are inserted between the bracket and the frames to move the frames laterally away from the bow. The frames preferably are centered over the arrow and bowstring.

The bracket of the mount is clamped between mounting block 43 and cap 44. The mounting block contains a groove that corresponds to the shape of the bracket. The groove is seen in the sectional portion of FIG. 6. The mounting block and cap contain four holes for cap screws 45 that attach the cap to the mounting block. The mounting block and the cap also contain two holes for mounting screws 46 that secure the entire sight to the bow. By loosening the cap, the U-shaped bracket can be moved front and back to any desired position. As shown in FIG. 6, the U-shaped bracket is positioned so that the near frame is closer to the bow than the far frame.

As previously mentioned, the U-shaped bracket of the preferred embodiment spaces the frames a distance of about 5 in (13 cm) apart. Brackets providing more or less spacing between the frames are also suitable. As the distance between the frames increases, the accuracy increases but the ease of use decreases. If desired, a pair of L-shaped arms or the like telescoping from the mounting block and cap can be substituted for the bracket so that the distance between the frames, and the distance from each frame to the bow can be easily changed.

The installation and calibration of the archery bow sight of this invention can now be considered. The following description applies to the preferred embodiment containing five corresponding pairs of horizontal filaments. It will be assumed that the archer has chosen to calibrate the sight for target distances of 10, 20, 30, 40, and 50 yards.

The first step is to install and/or remove filaments until only the vertical filament and the 30-yard horizontal filament in each frame are installed. The second step is to place all the filament arms in their middle positions, i.e., the arms for the vertical filaments are aligned parallel to the arrow and the arms for the horizontal filaments are aligned horizontally. The third step is to mount the sight on the bow. Most bows have pre-drilled holes for accepting archery bow sights so it is a simple matter to align the mounting block and cap over the holes and screw the sight to the bow with the mounting screws.

The fourth step is to adjust the front-to-back position of the frames. The adjustment is made by loosening the cap screws and sliding the U-shaped bracket. The near frame is generally positioned as close to the bow as possible. The far frame then extends several inches in front of the bow. The fifth step is to adjust the lateral position of the frames so that the vertical filament in each frame is centered over the arrow and bowstring. The frames are moved laterally by adding or removing spacers between the frames and the U-shaped bracket.

The sixth step of the calibration process requires the bow, sight, and a supply of arrows to be taken by the archer to a target range. The near frame is temporarily removed and a target is set at 30 yards. The bow is repeatedly shot by aiming the intersection of the vertical filament and the 30-yard horizontal filament of the far frame at the bull's eye of the target. The precise anchor point must be reached each time during the calibration process. The far frame is moved up and down relative to the U-shaped bracket until the arrows repeatedly hit at or near the bull's eye. The far frame is then tightened to the U-shaped bracket.

The seventh step is to make the fine adjustment of the vertical filament and the 30-yard filament of the far frame. The bow is again repeatedly shot by aiming the intersection of the vertical filament and the 30-yard horizontal filament of the far frame at the bull's eye of the target. Fine adjustments to the position of the vertical filament and 30-yard horizontal filament are made by rotating the appropriate pair of arms until the bull's eye is repeatedly struck.

The eighth step of the calibration process is to loosely attach the near frame. Without shooting, the frame is moved up and down until the corresponding pair of 30-yard filaments are superimposed when the bow is drawn to the anchor point. The near frame is then tightened. Fine adjustments are then made to the vertical filament and the 30-yard horizontal filament of the near frame by rotating the appropriate pair of filament arms until both corresponding pairs of filaments are superimposed when the bow is drawn to the precise anchor point.

The ninth step is to install the 20-yard horizontal filament in the far frame. The target is moved to 20 yards and the bow is repeatedly shot by aiming the intersection of the vertical filament and the 20-yard horizontal filament of the far frame at the bull's eye of the target. As previously mentioned, the precise anchor point must be reached each time the bow is shot. Fine adjustment to the position of the 20-yard horizontal filament is made by rotating the arms until the bull's eye is struck repeatedly.

The tenth step of the calibration process is to install the 20-yard horizontal filament in the near frame. Fine adjustment to the position of this filament is made by rotating the arms until the corresponding pair of 20-yard horizontal filaments are superimposed when the bow is drawn to the anchor point. The remaining steps of the calibration process are identical to the ninth and tenth steps, except for target distances of 10, 40, and 50 yards.

Once installation and calibration are completed, the archery bow sight is ready for use. To aim using the sight, the distance to the target must be known or estimated. The bow is held in the shooting position with the bowstring pulled to the anchor point. When the precise anchor point position is reached, each pair of corresponding filaments will be in superimposed alignment. The pairs will not be in superimposed alignment unless the precise anchor point is reached. The archer then moves the bow until the intersection of the vertical filaments and the appropriate horizontal filaments is directly in line with the target. The bow is now precisely aimed and the arrow can be released.

We claim:

1. An archery bow sight of the type that mounts on a bow above the handle and through which the archer views when holding the bow in a vertical shooting position and aiming at a target, the archery bow sight comprising:

(a) a near frame in a plane perpendicular to the plane formed by the bow and the bowstring, the near frame containing a filament that is vertical when the bow is in the shooting position and a plurality of filaments that are horizontal when the bow is in the shooting position, the filaments being in the same plane as the near frame; and (b) a far frame located farther away from the archer than the near frame when the bow is in the shooting position, the far frame being in a plane perpendicular to the plane formed by the bow and the bowstring, the far frame containing a filament that is vertical when the bow is in the shooting position and a plurality of filaments that are horizontal when the bow is in the shooting position, the filaments being in the same plane as the far frame, each filament in the far frame corresponding to a filament in the near frame to form a corresponding pair, the spaces between the horizontal filaments in the far frame being greater than the spaces between the horizontal filaments in the near frame, the filaments in the far frame located in a plane passing through the corresponding filament in the near frame and the eye of the archer so that each pair of corresponding filaments appear superimposed when the bow is in the shooting position, the intersection of the corresponding vertical filaments and each pair of corresponding horizontal filaments defining a sight for a target of a particular distance.

2. The archery bow sight of claim 1 wherein each frame contains at least three horizontal filaments.

3. The archery bow sight of claim 2 wherein each frame contains one vertical filament.

4. The archery bow sight of claim 3 wherein the horizontal filaments are suspended between two arms movably attached to the frame to adjust the filaments vertically.

5. The archery bow sight of claim 4 wherein the vertical filaments are suspended between two arms movably attached to the frame to adjust the filaments horizontally.

6. The archery bow sight of claim 5 wherein the near frame and far frame are rectangular in shape.

7. The archery bow sight of claim 6 wherein each corresponding pair of horizontal filaments is the same color and is a different color than the adjacent corresponding pairs of horizontal filaments.

8. A method of shooting a bow and arrow at a target, the method comprising:

(a) holding a bow and arrow in a vertical shooting position while viewing the target through an archery bow sight mounted on the bow above the handle, the archery bow sight comprising:

(i) a near frame in a plane perpendicular to the plane formed by the bow and the bowstring, the near frame containing a filament that is vertical when the bow is in the shooting position and a plurality of filaments that are horizontal when the bow is in the shooting position, the filaments being in the same plane as the near frame; and (ii) a far frame located farther away than the near frame when the bow is in the shooting position, the far frame being in a plane perpendicular to the plane formed by the bow and the bowstring, the far frame containing a filament that is vertical when the bow is in the shooting position and a plurality of filaments that are horizontal when the bow is in the shooting position, the filaments being in the same plane as the far frame, each filament in the far frame corresponding to a filament in the near frame to form a corresponding pair, the spaces between the horizontal filaments in the far frame being greater than the spaces between the horizontal filaments in the near frame, the filaments in the far frame located in a plane passing through the corresponding filament in the near frame and the eye so that each pair of corresponding filaments appear superimposed when the bow is in the shooting position, the intersection of the corresponding vertical filaments and each pair of corresponding horizontal filaments defining a sight for a target of a particular distance (b) choosing the appropriate pair of corresponding horizontal filaments for the distance of the target;

(c) aligning the intersection of the vertical filaments and the appropriate pair of corresponding horizontal filaments on the target; and (d) releasing the arrow.

9. The method of claim 8 wherein each frame of the archery bow sight contains at least three horizontal filaments.

10. The method of claim 9 wherein each frame of the archery bow sight contains one vertical filament.

11. The method of claim 10 wherein the horizontal filaments of the archery bow sight are suspended between two arms movably attached to the frame to adjust the filaments vertically.

12. The method of claim 11 wherein the vertical filaments of the archery bow sight are suspended between two arms movably attached to the frame to adjust the filaments horizontally.

13. The method of claim 12 wherein the near frame and far frame of the archery bow sight are rectangular in shape.

14. The method of claim 13 wherein each corresponding pair of horizontal filaments in the archery bow sight is the same color and is a different color than the adjacent corresponding pairs of horizontal filaments.

* * * * *